US006250287B1

(12) United States Patent
Wickman et al.

(10) Patent No.: US 6,250,287 B1
(45) Date of Patent: Jun. 26, 2001

(54) FUEL DELIVERY SYSTEM FOR A MARINE ENGINE

(75) Inventors: Timothy P. Wickman; Robert Kleeman, both of Fond du Lac; Ervin H. Voss, Jr., Princeton; David C. Entringer, Wautoma, all of WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/525,733

(22) Filed: Mar. 14, 2000

(51) Int. Cl.[7] ..... F02M 37/04
(52) U.S. Cl. ..... 123/497; 123/509
(58) Field of Search ..... 123/509, 495–7; 73/119 A, 118.1

(56) References Cited

U.S. PATENT DOCUMENTS

| | | | | |
|---|---|---|---|---|
| 2,656,828 | | 10/1953 | Conover | 123/139 |
| 2,672,824 | | 3/1954 | Quintilian | 103/126 |
| 2,672,825 | | 3/1954 | Quintilian | 103/126 |
| 2,753,810 | | 7/1956 | Quintilian | 103/126 |
| 2,872,872 | | 2/1959 | Quintilian | 103/126 |
| 4,142,486 | * | 3/1979 | Schreier | 123/73 AD |
| 4,594,970 | | 6/1986 | Baars et al. | 123/73 |
| 4,743,171 | * | 5/1988 | Mahoney | 417/349 |
| 4,784,104 | | 11/1988 | Dimond | 123/514 |
| 4,848,283 | | 7/1989 | Garms et al. | 123/73 |
| 4,911,203 | | 3/1990 | Garms | 137/614 |
| 5,386,721 | * | 2/1995 | Alvizar | 73/116 |
| 6,158,975 | * | 12/2000 | Dill et al. | 123/509 |

* cited by examiner

*Primary Examiner*—Thomas N. Moulis
(74) *Attorney, Agent, or Firm*—William D. Lanyi

(57) ABSTRACT

A fuel pump is housed within the structure of a portable fuel tank. The inlet of the pump is located in the lower portion of the tank and an outlet of the pump is connectable in fluid communication with a flexible conduit. An opposite end of the flexible conduit is connectable in fluid communication with the fuel system of an outboard motor. A water sensor and a fuel level sensor can be provided in conjunction with the pump and attached to the pump in certain embodiments. A fuel pressure regulator is connected in fluid communication with the outlet of the pump and also located within the structure of the portable fuel tank.

19 Claims, 5 Drawing Sheets

FUEL DELIVERY SYSTEM FOR A MARINE ENGINE

BACKGROUND OF THE INVENTION

1. Field of the Invention

The present invention is generally related to a fuel delivery system for a marine engine and, more particularly, to a fuel system that includes a portable fuel tank with an internal pump that regulates the pressure of fuel pumped from the portable tank through a flexible conduit to a marine engine.

2. Description of the Prior Art

Portable fuel tanks have been used in conjunction with marine engines, such as outboard motors, for many years. Typically, fuel is drawn from the portable fuel tank by a vacuum created within a flexible hose connecting the fuel tank to the outboard motor. Under the cowl of the outboard motor, a lift pump typically draws the fuel from the portable fuel tank and provides the fuel, under pressure, to the internal combustion engine of the outboard motor. This arrangement has been used in conjunction with carbureted engines and fuel injected engines.

A serious problem can occur when a fuel pump of an outboard motor is used to draw fuel from a fuel tank. Particularly in hot weather, the fuel can vaporize and, especially under the influence of lower pressures at the inlet of the fuel pump, the fuel delivery system can experience vapor lock. Vapor lock is a familiar problem to users of outboard motors and refers to the inability of a fuel pump to draw liquid fuel to its inlet because of the presence of fuel vapor within the fuel line.

The use of a portable fuel tank in conjunction with an outboard motor is very well known to those skilled in the art.

U.S. Pat. No. 4,594,970, which issued to Baars et al on Jun. 17, 1986, describes a marine installation including a fuel/oil mixing device. The installation comprises a marine propulsion device including a propulsion unit having a lower unit supporting a propeller and a power head including a two-stroke internal combustion engine having an apparatus for feeding a fuel/oil mixture to the engine and including a fuel/oil mixture pump having an inlet and being operable to create suction at the inlet, a flexible hose releasably connected to and communicating with the inlet of the fuel/oil mixture pump, and a remote tank having an interior providing a fuel reservoir.

U.S. Pat. No. 4,784,104, which issued to Dimond on Nov. 15, 1988, discloses a fuel line with an integral coaxial return line. The fuel system for an internal combustion engine has a fuel pump communicating with a fuel tank and delivering fuel to a fuel monitoring device and including a device for detecting and returning excess for vaporized fuel to the tank. The system is provided with a return fuel line for returning the detected vaporized or excess fuel to the tank with at least a portion of the return fuel line coaxial with and contained within the supply line.

U.S. Pat. No. 4,848,283, which issued to Garms et al on Jul. 18, 1989, discloses a marine engine with a combination vapor return, crankcase pressure, and cooled fuel line conduit. A marine propulsion system includes a two cycle water cooled crankcase compression internal combustion engine including a vapor separator, a remote fuel tank, and a fuel pump in the tank for delivering fuel to the engine in response to crankcase pulse pressure. A combination conduit between the fuel tank and the engine includes a first passage communicating crankcase pulse pressure from the engine to the fuel pump in the tank, a second passage supplying fuel from the pump in the tank to the engine, a third passage returning fuel vapor from the vapor separator at the engine back to the tank, a fourth passage supplying cooling water from the engine towards the tank, and a fifth passage returning water from the fourth passage back to the engine.

U.S. Pat. No. 4,911,203, which issued to Garms on Mar. 27, 1990, describes a fuel line connector. A coupling assembly for connecting conduits conveying fuel under pressure, utilizes a pair of seals so as to define a chamber for the containment of excess pressurized fuel during the disengagement of the coupling members. A protective shield or flange is provided around the locking mechanism so as to prevent inadvertent contact with the release mechanism and accidental disengagement of the coupling members.

U.S. Pat. No. 2,656,828, which issued to Conover on Oct. 27, 1953, describes a fuel supplying means using a crankcase pressure developed in a two-cycle engine for delivering fuel to the carburetor. A fuel tank, which is separate from the powerhead of an engine, and connected therewith for use, is readily separated from the powerhead for independent transportation. The weight of the outboard motor as such is greatly reduced, thus facilitating transportation and mounting and dismounting.

Certain types of pumps are referred to by those skilled in the art as "Gerotors" pumps. Various types of Gerotor pumps are described in detail in patents that issued to Quintilian. For example, U.S. Pat. No. 2,672,825, which issued to Quintilian on May 23, 1954, describes a hydraulic pump and motor. Similarly, U.S. Pat. No. 2,672,824, which also issued on Mar. 23, 1954, describes a hydraulic pump or motor. U.S. Pat. No. 2,753,810, which issued to Quintilian on Jul. 10, 1956, also describes a pump or motor. U.S. Pat. No. 2,872,872, which issued to Quintilian on Feb. 10, 1959, describes a hydraulic pump or motor. As will be described below in greater detail in the description of the preferred embodiment, certain types of Gerotor pumps are particularly applicable for use in conjunction with the present invention.

The patents described above are hereby explicitly incorporated herein.

If a fuel pump could be satisfactorily contained within a portable fuel tank, many problems relating to vapor lock would be eliminated. As a result, other components normally contained under the cowl of an outboard motor could be eliminated since some of those components have a primary function of eliminating or minimizing vapor lock. It would therefore be significantly beneficial if a portable fuel tank could be provided with a pump within the fuel tank in a way that satisfactorily provides fuel to a marine engine, minimizes the likelihood of vapor lock problems, and reduces the overall cost of the marine engine system.

SUMMARY OF THE INVENTION

A preferred embodiment of the present invention provides a fuel delivery system for a marine engine that comprises a portable fuel tank. The portable fuel tank is manually transportable from a first location to a second location, such as from a boat to a dock or to a location where the portable fuel tank can be filled with gasoline. The present invention further comprises a pump which is disposed within the fuel tank and which has an inlet and an outlet. The outlet is connectable in fluid communication with a flexible conduit, or hose, and the inlet is disposed proximate a bottom portion of the fuel tank when the fuel tank is in normal use. The pump is provided with a fuel pressure regulator that is connected in fluid communication with the outlet of the pump in order to maintain a pressure at the outlet which is less than or equal to a preselected maximum value. An electrical conductor is connected to the pump and is extendable from the fuel tank to a source of electrical power, such as a outboard motor engine or a battery.

In certain embodiments of the present invention, the fuel delivery system further comprises a water separating fuel filter that is connected in fluid communication with the inlet of the pump and is disposed within the fuel tank, wherein fuel passing into the inlet of the pump must pass through the water separating fuel filter first. The flexible conduit attached to the outlet of the pump is typically a rubber hose braided reinforced which extends from the fuel tank to the marine engine. The electrical conductor is contained in a common bundle with the flexible conduit in one embodiment of the present invention and the source of electrical power is a marine engine.

A water in fuel sensor can be connected to the pump and disposed proximate the bottom portion of the fuel tank in order to detect water within the bottom portion of the tank. If water is contained within the fuel tank, in combination with gasoline, the water will settle at the bottom portion of the tank and be detectable. A fuel level sensor can also be provided in certain embodiments of the present invention and connected to the pump. A signal conductor is connected in signal communication with the fuel level sensor and extends from the fuel tank to provide a signal that represents the level of fuel within the portable fuel tank.

The pump can extend through a top or bottom portion of the fuel tank and is supported by the top portion of the fuel tank. A first connector is attached to the outlet of the pump and is connectable to the flexible conduit. The first connector is self sealing when a first end of the flexible conduit is not connected to the first connector. A second connector is attached to the marine engine. The second connector is self sealing when a second end of the flexible conduit is not connected to the second connector. The flexible conduit is connectable between the first and second connectors to provide fluid communication between the outlet of the pump and the marine engine. The first connector can be configured to electrically disconnect the pump from the source of electrical power whenever the flexible conduit is disconnected from the outlet of the pump.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
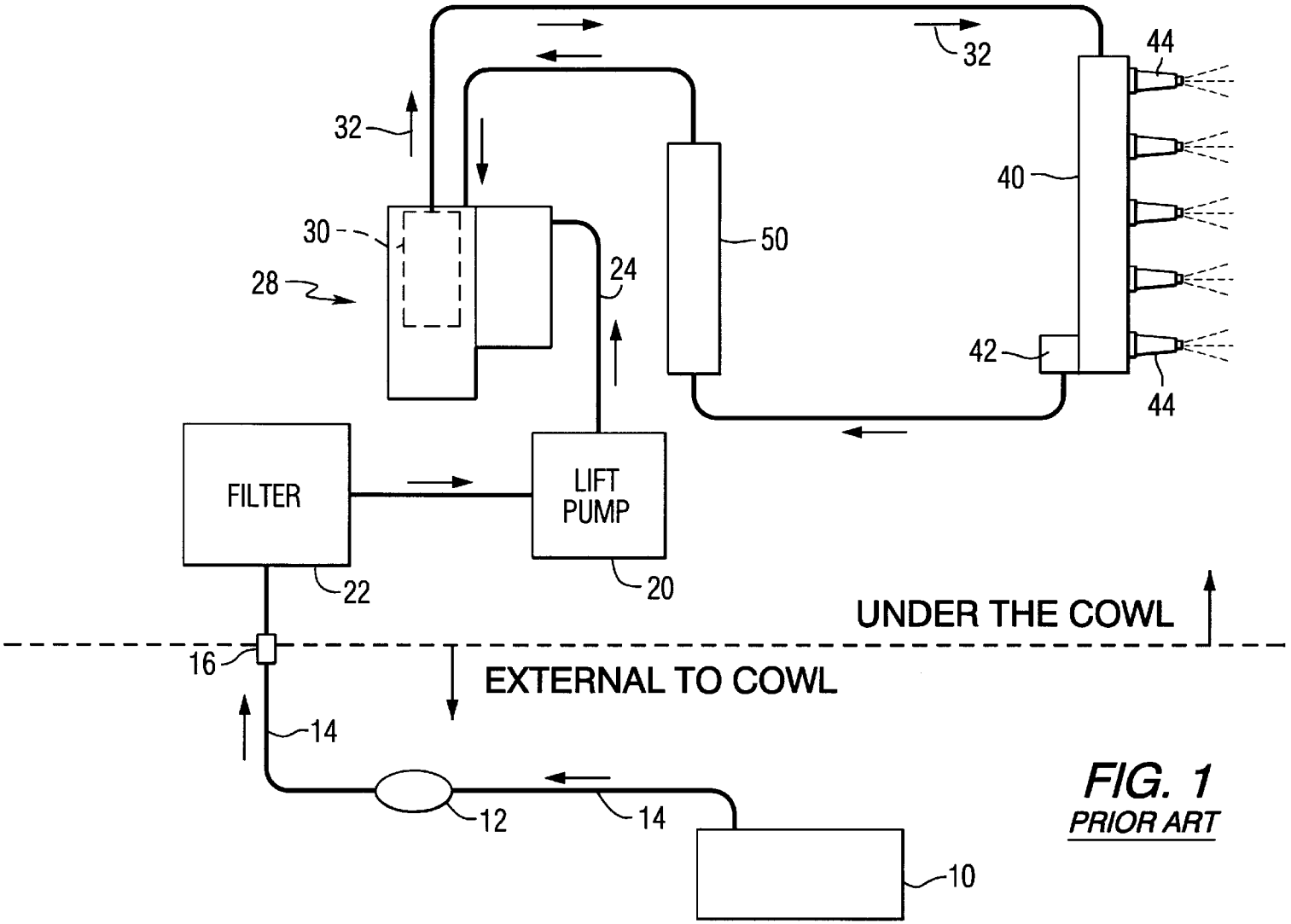
FIG. 1 PRIOR ART
FIG. 1 is a schematic representation of a prior art arrangement of a fuel system.

Throughout the description of the preferred embodiment of the present invention, like components will be identified by like reference numerals.

FIG. 1 is a simplified schematic representation of a known arrangement for a marine propulsion system. A portable fuel tank 10 is typically provided with a primer bulb 12 to fill a flexible conduit 14 with fuel from the tank 10. A connector 16 allows the conduit 14, which is typically a rubber hose, to be connected to a fuel system of an outboard motor that is contained under a cowl.

Under the cowl of an outboard motor, a lift pump 20 draws fuel from the conduit 14, through the connector 16, and through a filter 22. The lift pump 20 provides the liquid fuel through a conduit 24 to a fuel vapor separator 28. Within the fuel vapor separator 28, a high pressure pump 30 causes the fuel to flow in the direction represented by arrows 32, to a fuel rail 40. A regulator 42 controls the pressure within the passages of the fuel rail 40. From the fuel rail 40, liquid fuel is caused to flow under pressure through fuel injectors nozzles 44 which are individually associated with cylinders of an internal combustion engine. For purposes of simplicity, the internal combustion engine, its cylinders, and pistons are not illustrated in FIG. 1. However, those skilled in the art of engine design are very familiar with the manner in which a fuel rail 40 and fuel injectors 44 can be associated with an internal combustion engine, either in a direct fuel injection (DFI) system or an electronic fuel injection (EFI) system.

With continued reference to FIG. 1, a fuel cooler 50 is shown connected between the regulator 42 and a return inlet of the fuel vapor separator 28. The simplified schematic representation of FIG. 1 is provided for the purpose of showing the basic arrangement of the components in a fuel system which is applicable for use with a portable fuel tank 10.

Figure 2:
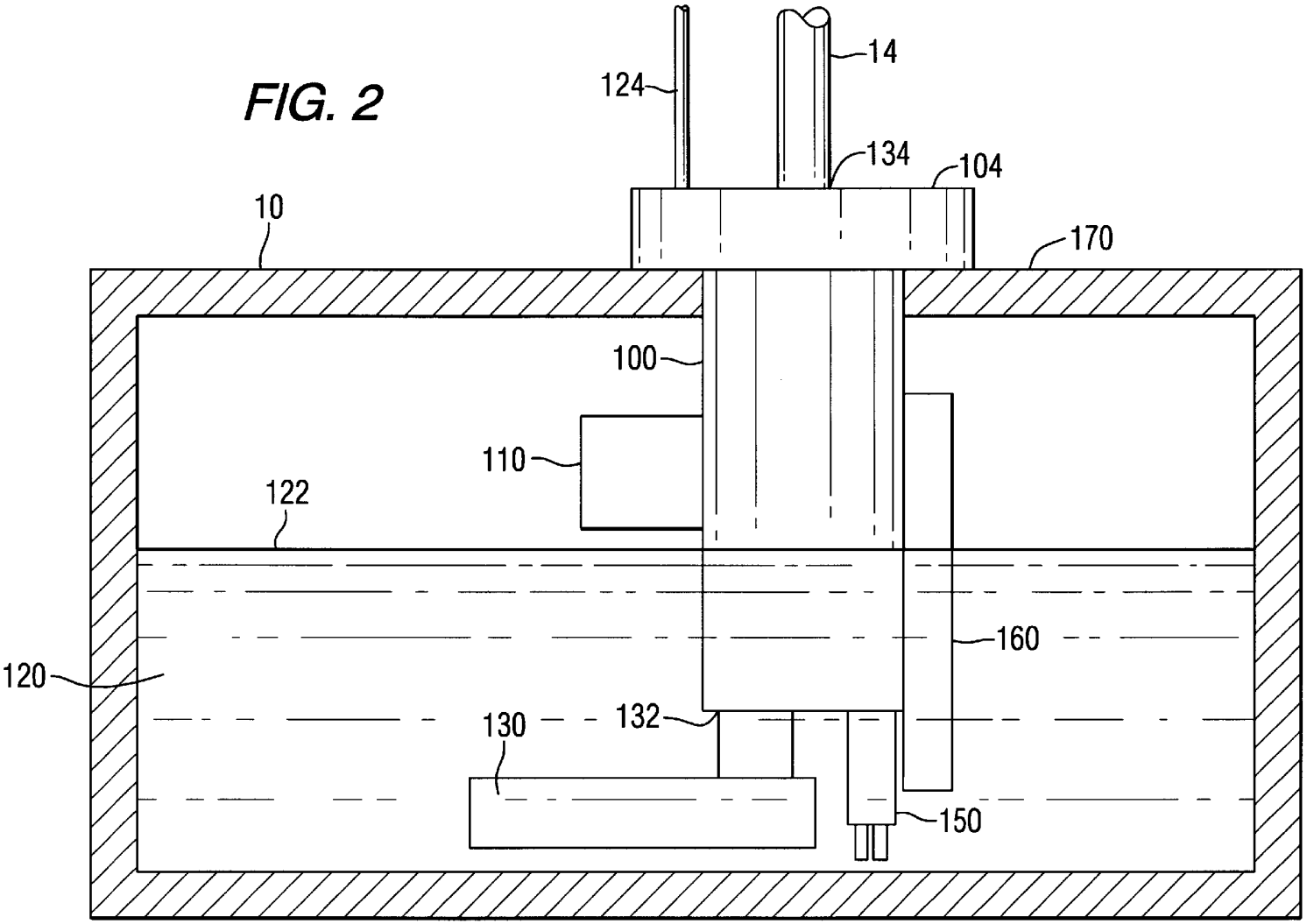
FIG. 2 is a schematic section view of a fuel tank incorporating the present invention.

As an improvement on the known system shown in FIG. 1, the present invention provides a pump 100 within the portable fuel tank 10 as shown in FIG. 2. This eliminates the need for the lift pump 20 under the cowl of the outboard motor. The pump 100 is attached to a lid 104 that allows the pump 100 to be inserted into the fuel tank 10 and rigidly attached to the top portion of the fuel tank 10 by a retaining ring, or cap. A regulator 110 is connected to the pump 100 and in fluid communication with the pump 100 to maintain a predetermined pressure within a flexible conduit 14 at a preselected magnitude. Excess fuel is allowed to flow from the pump 100 back to the stored fuel reservoir 120 within the tank 10. An electrical conductor 124 is provided for the purpose of connecting the pump 100 to an electrical power supply. The power supply can be an external battery or a generator located under the cowl of the outboard motor.

With continued reference to FIG. 2, a water separating fuel filter 130 is connected to an inlet 132 of the pump 100. The water separating fuel filter prevents water from being drawn from the reservoir 120 of liquid fuel and into the pump 100. The fuel drawn through the filter 130 is pumped upward and through an outlet 134 of the pump 100 which is connected to the conduit 14.

With continued reference to FIG. 2, a water sensor 150 is attached to the pump 100 and connected in signal communication with the outboard motor. The signal from the water sensor 150 can be used to notify the operator that water has collected in the bottom portion of the portable fuel tank 10. A fuel level sensor, which is schematically represented in FIG. 2 and identified by reference numeral 160 can be attached to the pump 100 and used to provide an indication of the liquid fuel level 122. Signal lines (not shown in FIG. 2) can connect the various sensors in signal communication with an annunciator or microprocessor of the outboard motor.

As can be seen in FIG. 2, the pump 100 extends downward through a top portion 170 of the portable fuel tank 10. Electrical power is provided to the pump and its associated components by a conductor 124. A signal conductor, not shown specifically in FIG. 2, is provided to allow signals from the water sensor 150 and fuel level sensor 160 to be transmitted to an engine control unit (ECU) associated with the outboard motor. Alternatively, more simplified systems can incorporate more simple signal annunciators, such as light emitting diodes or forms.

Figure 3:
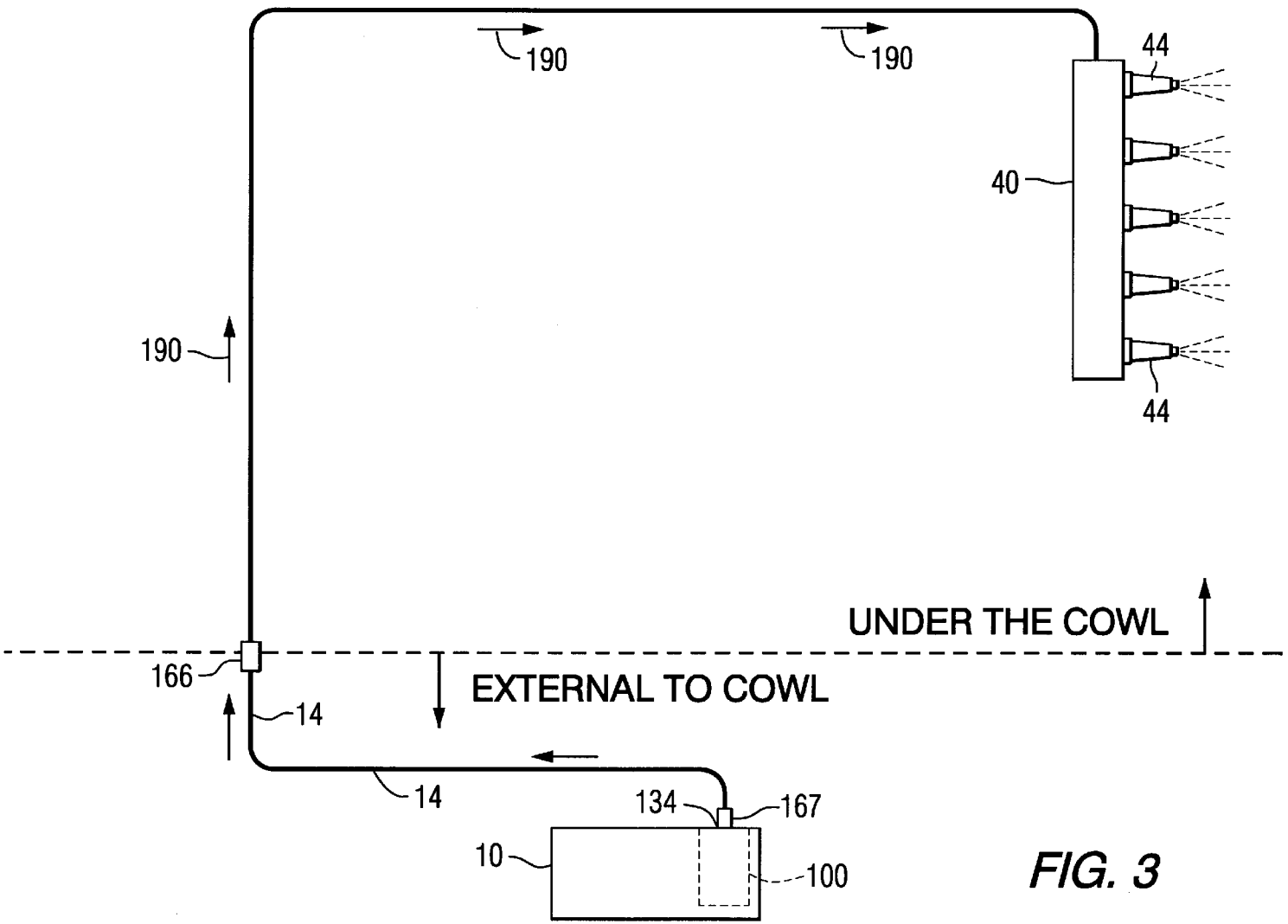
FIG. 3 is schematic representation of a fuel system incorporating the present invention.

The benefits achieved through the incorporation of the present invention can be seen in the schematic representation of FIG. 3. The use of the pump 100 within the portable fuel tank 10 eliminates the need for many other components that would otherwise be required under the cowl of the outboard motor as shown in FIG. 1. The pressurized fuel in the flexible conduit 14 and in the fuel system conduit 190 is caused to flow directly to the fuel rail 40 and its injectors 44. It should be noted that no regulator 42 as described in FIG. 1, is required under the cowl because the fuel pressure is regulated by the regulator 110 within the tank 10 as described above in conjunction with FIG. 2. Furthermore, the fuel line 190 can be "dead headed" with the fuel rail 40 without a return path to any other component. Similarly, it should be noted that the fuel vapor separator 28 in FIG. 1 is no longer necessary. By comparing FIGS. 1 and 3, it can also be seen that the fuel cooler 50, the filter 22, and the lift pump 20 are no longer necessary under the cowl of the outboard motor. The fuel cooler 50 and the fuel vapor separator 28 are typically provided to achieve the goal of preventing vapor lock from occurring at fuel pump 30 in FIG. 1. The pump 20 is also a location where vapor lock can occur. Since the pump 100 of the present invention pumps directly from the liquid fuel reservoir 120 within the portable tank 10, vapor lock is prevented without the need of either the fuel vapor separator 28 or the cooler 50. Furthermore, since the fuel is not constantly being recirculated through the fuel rail 40, additional heat is not added to the liquid fuel by the constant recirculation process. A comparison of FIGS. 1 and 3 clearly show the significant advantages provided by the present invention.

Figure 4:
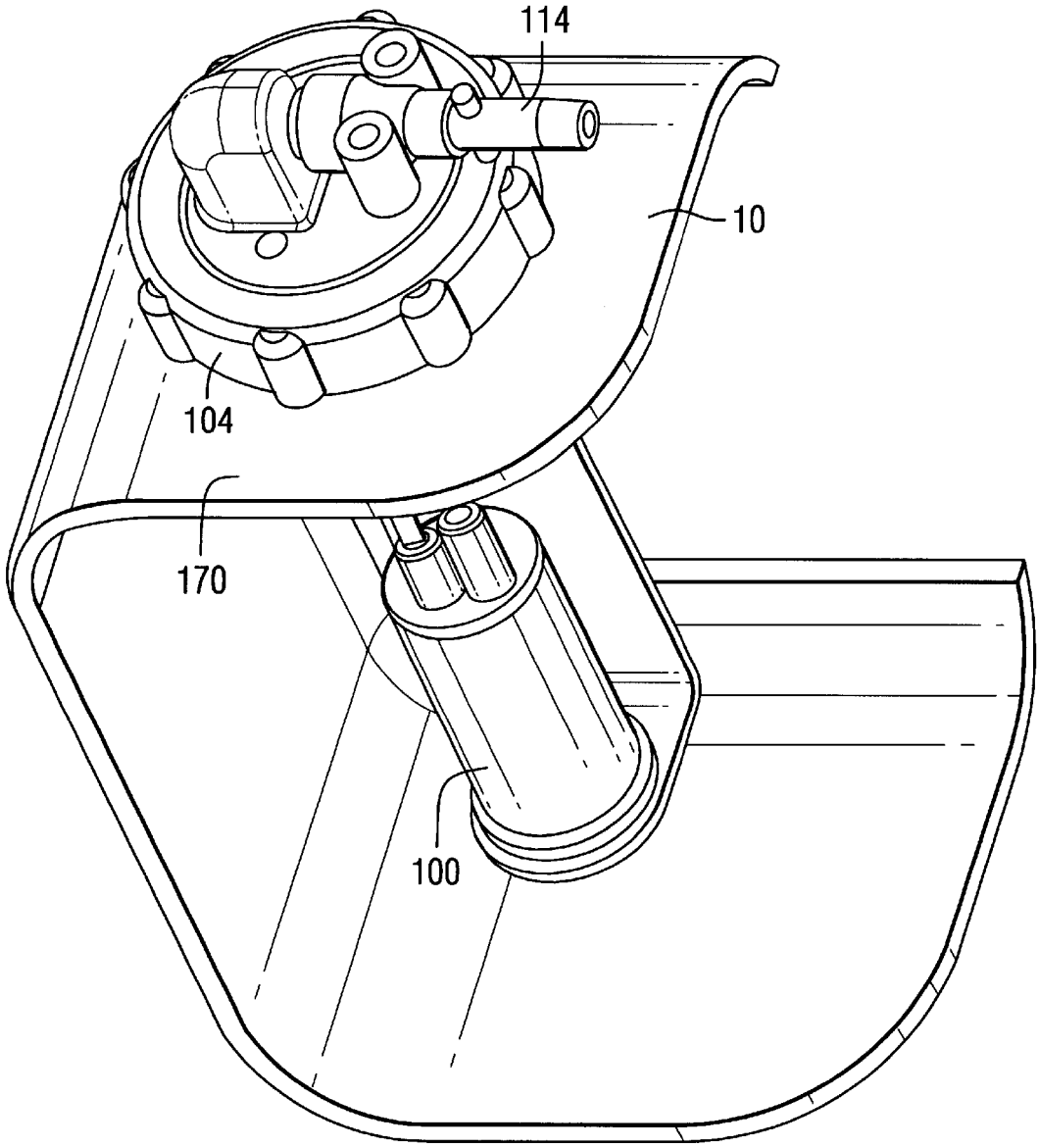
FIGS. 4, 5, and 6 are various section views of a portable fuel tank incorporating the present invention.

FIG. 4 is an isometric representation of a section view of part of a fuel tank 10 housing. The cap 104, or lid, is threaded onto a threaded lip of a opening of the top portion 170 of the fuel tank 10. The pump 100 is suspended from the top portion 170 of the tank. A nipple 114 is provided for connection with a flexible conduit 14 shown in FIGS. 1 and 3 and described above. The pump 100 and its associated components described above in conjunction with FIG. 2 are all attached for support to the top portion 170 of the portable fuel tank 10 and, as a result, move with the portable fuel tank 10 when its is moved from one position to another.

Figure 6:
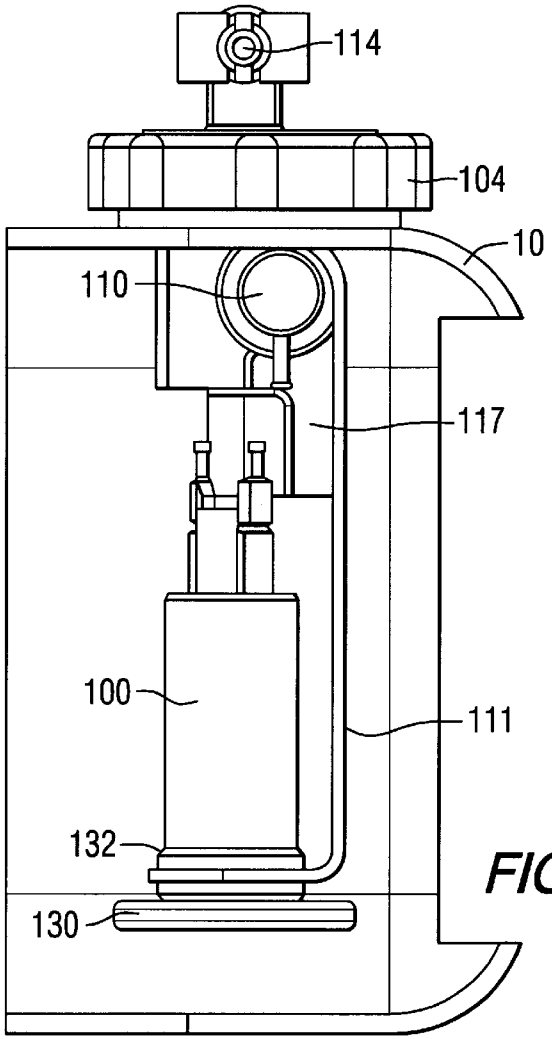
Figure 5:
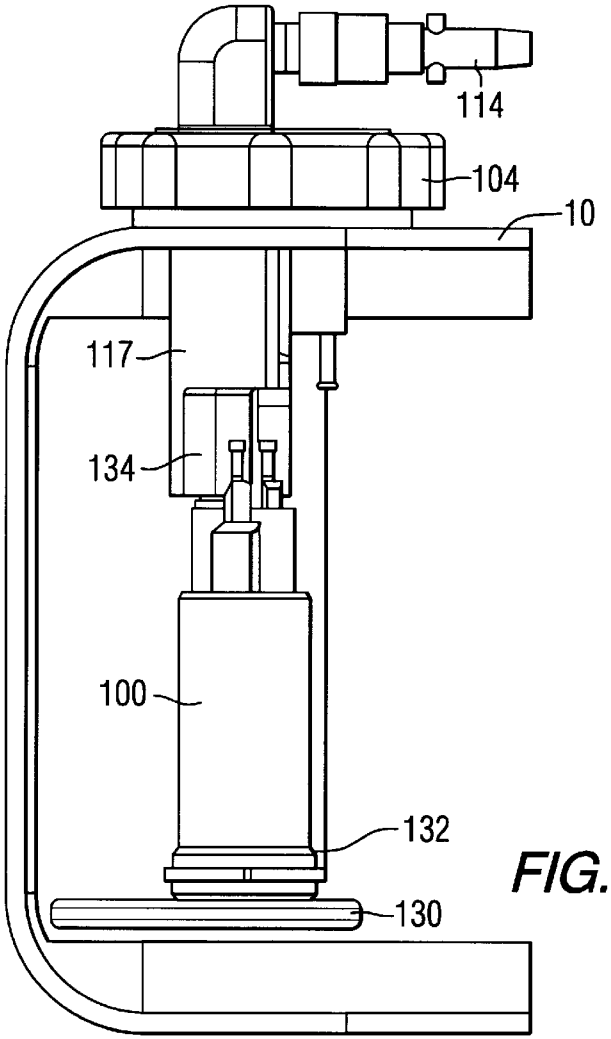

FIGS. 5 and 6 are two alternative views of the present invention as described above in conjunction with FIG. 4. A pump 100 is supported by a bracket 111. The outlet 134 of the pump 100 is connected in fluid communication with the nipple 114. The inlet 132 of the pump is connected to the water separating fuel filter 130 in the manner described above. Although not clearly shown in FIGS. 4, 5, and 6, the water sensor 150 and water level detector 116 can easily be mounted with the pump 100 to the bracket 111 or, alternatively, these components can be attached directly to the pump 100. Support structure 117 contains fluid passages and electrical connections.

With reference to FIGS. 1–6, it has been determined that the pressure within the conduit 14 should be maintained at approximately 30 to 45 psi by the regulator 110 in a preferred embodiment of the present invention. In addition, the pump 100 in a preferred embodiment of the present invention can be a Gerotor, turbine or roller vane pump. In a particularly preferred embodiment of the present invention, a Gerotor pump can be used. Alternatively, a roller vane pump or turbine pump is also applicable for use in association with the present invention. In a preferred embodiment of the present invention, the pump 100 operates on a 14.4 volt DC power system.

With reference to FIG. 3, a connector 166 is shown connecting the flexible conduit 14 to the fuel system 190 of an outboard motor. Another connector 167 is shown connecting the flexible conduit 14 to the outlet 134 of the pump 100. Various types of connectors are known to those skilled in the art for use in connecting a flexible hose between a portable fuel tank 10 and the fuel system of an outboard motor. Connectors of the known type are applicable for use with the present invention. However, since the present invention requires the provision of electrical power from an external source to the portable fuel tank 10 for operation of the pump 100 and the associated components within the tank, it is sometimes advantageous to provide the electrical connection in close association with the flexible conduit 14. If the electrical conductor is closely associated with the flexible conduit 14, it is advantageous to provide these various conductors within a common bundle or cable structure. Although not specifically illustrated in the Figures, this arrangement improves the convenience for the operator. Furthermore, when the electrical conductor is provided in close proximity with the flexible conduit 14, the connectors, 166 and 167, can be structured so that the electrical connection between the pump 100 and the outboard motor is disconnected whenever the flexible conduit 14 is detached from either the fuel tank 10 or the fuel system 190. This improves the convenience of use of the present invention and also performs a safety function by disconnecting the pump 100 whenever the fluid connection, such as the flexible conduit 14, is disconnected.

With regard to the fuel level switch 160, various types of switches are commercially available. For example, the Kobold Corporation provides a level switch identified as "NKP" which has a polypropylene float and housing with a half inch NPT or bulk head fitting and a horizontal orientation. The water sensor 150 is available in commercial quantities from the Racor Division of the Parker Hannifin Corporation. It is useful to provide connectors, 166 and 167, of the type that are self sealing when they are disconnected. These typically incorporate a check valve within each connector. One type of check valve connector is available in commercial quantities from ITT Industries Fluid Handling Systems. The flexible conduit 14 can be any type of acceptable flexible hose that is usable in marine applications. It should conform to the necessary regulations and standards, such as SAE 30R9.

By incorporating a pump 100 within a portable fuel tank 10, the present invention allows the elimination of many components that would otherwise be required under the cowl of an outboard motor. It also significantly decreases the likelihood of vapor lock because the inlet of the pump 100 is submerged under the liquid level of fuel within a fuel tank.

Although the present invention has been described with particular specificity and illustrated to show a particularly preferred embodiment, it should be understood that alternative embodiments are also within its scope.

We claim:

1. A fuel delivery system for a marine engine, comprising:

a portable fuel tank, said portable fuel tank being manually transportable from a first location to a second location;

a pump disposed within said fuel tank, said pump having an inlet and an outlet, said outlet being connectable in fluid communication with a flexible conduit, said inlet being disposed proximate a bottom portion of said fuel tank when said fuel tank is in normal use;

a pressure regulator connected in fluid communication with said outlet to maintain a pressure at said outlet less than or equal to a preselected maximum value;

an electrical conductor connected to said pump and extendable from said fuel tank to a source of electrical power;

a fuel level sensor connected to said pump; and a signal conductor connected in signal communication with said fuel level sensor and extending from said fuel tank.

2. The fuel delivery system of claim 1, further comprising:

a water separating fuel filter connected in fluid communication with said inlet and disposed within said fuel tank, wherein fuel passing into said inlet must pass through said water separating fuel filter.

3. The fuel delivery system of claim 1, further comprising:

said flexible conduit attached to said outlet and extending from said fuel tank to said marine engine.

4. The fuel delivery system of claim 3, wherein:

said electrical conductor is contained in a common bundle with said flexible conduit, said source of electrical power being said marine engine.

5. The fuel delivery system of claim 1, further comprising:

a water sensor connected to said pump and disposed proximate said bottom portion of said fuel tank to detect water within said bottom portion of said tank.

6. The fuel delivery system of claim 1, wherein:

said pump extends through a top portion of said fuel tank and is supported by said top portion of said fuel tank.

7. The fuel delivery system of claim 1, further comprising:

a first connector attached to said outlet of said pump and connectable to said flexible conduit, said first connector being self sealing when a first end of said flexible conduit is not connected to said first connector.

8. The fuel delivery system of claim 7, further comprising:

a second connector attached to said marine engine, said second connector being self sealing when a second end of said flexible conduit is not connected to said second connector, said flexible conduit being connectable between said first and second connectors to provide fluid communication between said outlet of said pump and said marine engine.

9. The fuel delivery system of claim 7, wherein:

said first connector is configured to electrically disconnect said pump from said source of electrical power whenever said flexible conduit is disconnected from said outlet.

10. A fuel delivery system for a marine engine, comprising:

a portable fuel tank, said portable fuel tank being manually transportable from a first location to a second location;

a pump disposed within said fuel tank, said pump having an inlet and an outlet, said outlet being connectable in fluid communication with a flexible conduit, said inlet being disposed proximate a bottom portion of said fuel tank when said fuel tank is in normal use;

a pressure regulator connected in fluid communication with said outlet to maintain a pressure at said outlet less than a preselected maximum value;

an electrical conductor connected to said pump and extendable from said fuel tank to a source of electrical power; and a water separating fuel filter connected in fluid communication with said inlet and disposed within said fuel tank, wherein fuel passing into said inlet must pass through said water separating fuel filter.

11. The fuel delivery system of claim 10, further comprising:

said flexible conduit attached to said outlet and extending from said fuel tank to said marine engine.

12. The fuel delivery system of claim 11, further comprising:

a water sensor connected to said pump and disposed proximate said bottom portion of said fuel tank to detect water within said bottom portion of said tank.

13. The fuel delivery system of claim 12, further comprising:

a fuel level sensor connected to said pump; and a signal conductor connected in signal communication with said fuel level sensor and extending from said fuel tank.

14. The fuel delivery system of claim 13, wherein:

said pump extends through a top portion of said fuel tank and is supported by said top portion of said fuel tank.

15. The fuel delivery system of claim 14, further comprising:

a first connector attached to said outlet of said pump and connectable to said flexible conduit, said first connector being self sealing when a first end of said flexible conduit is not connected to said first connector; and a second connector attached to said marine engine, said second connector being self sealing when a second end of said flexible conduit is not connected to said second connector, said flexible conduit being connectable between said first and second connectors to provide fluid communication between said outlet of said pump and said marine engine.

16. The fuel delivery system of claim 15, wherein: p1 said first connector is configured to electrically disconnect said pump from said source of electrical power whenever said flexible conduit is disconnected from said outlet.

17. A fuel delivery system for a marine engine, comprising:

a portable fuel tank, said portable fuel tank being manually transportable from a first location to a second location;

a pump disposed within said fuel tank, said pump having an inlet and an outlet, said outlet being connectable in fluid communication with a flexible conduit, said inlet being disposed proximate a bottom portion of said fuel tank when said fuel tank is in normal use;

a pressure regulator connected in fluid communication with said outlet to maintain a pressure at said outlet less than a preselected maximum value;

an electrical conductor connected to said pump and extendable from said fuel tank to a source of electrical power;

a water separating fuel filter connected in fluid communication with said inlet and disposed within said fuel tank, wherein fuel passing into said inlet must pass through said water separating fuel filter;

said flexible conduit attached to said outlet and extending from said fuel tank to said marine engine;

a fuel level sensor connected to said pump; and a signal conductor connected in signal communication with said fuel level sensor and extending from said fuel tank.

18. The fuel delivery system of claim 17, further comprising:

a water sensor connected to said pump and disposed proximate said bottom portion of said fuel tank to detect water within said bottom portion of said tank, said pump extending through a top portion of said fuel tank and is supported by said top portion of said fuel tank.

19. The fuel delivery system of claim 18, further comprising:

a first connector attached to said outlet of said pump and connectable to said flexible conduit, said first connector being self sealing when a first end of said flexible conduit is not connected to said first connector; and a second connector attached to said marine engine, said second connector being self sealing when a second end of said flexible conduit is not connected to said second connector, said flexible conduit being connectable between said first and second connectors to provide fluid communication between said outlet of said pump and said marine engine, said first connector being configured to electrically disconnect said pump from said source of electrical power whenever said flexible conduit is disconnected from said outlet.

* * * * *